United States Patent [19]

Newton et al.

[11] 3,975,656

[45] Aug. 17, 1976

[54] DIRECT VIEW STORAGE TUBE

[75] Inventors: John W. Newton, Pine City; Wilson G. Helt, Elmira, both of N.Y.

[73] Assignee: Westinghouse Electric Corporation, Pittsburgh, Pa.

[22] Filed: Jan. 10, 1975

[21] Appl. No.: 540,209

Related U.S. Application Data

[63] Continuation of Ser. No. 138,447, April 29, 1971.

[52] U.S. Cl. ..... 313/397; 313/395

[51] Int. Cl.[2] ..... H01J 29/08; H01J 29/39

[58] Field of Search ..... 313/397

[56] References Cited

UNITED STATES PATENTS

| | | | |
|---|---|---|---|
| 2,879,442 | 3/1959 | Kompfner et al. | 313/397 X |
| 3,165,664 | 1/1965 | Callick | 315/12 |
| 3,480,482 | 11/1969 | Picker | 148/6.3 |

*Primary Examiner*—Robert Segal

*Attorney, Agent, or Firm*—W. G. Sutcliff

[57] ABSTRACT

A direct view storage tube with improved brightness and contrast provided by means of a current grain electrode positioned between the storage electrode and the output screen of the tube.

3 Claims, 4 Drawing Figures

INVENTORS
John W. Newton &
Wilson G. Helt.
BY Charles F. Renz
ATTORNEY

DIRECT VIEW STORAGE TUBE

This is a continuation of application Ser. No. 138,447 filed Apr. 29, 1971.

BACKGROUND OF THE INVENTION

A direct view storage tube normally comprises a foraminous storage grid, an electron gun for writing information onto said storage grid, a flood electron gun for reading and erasing information on said storage grid and a phosphor display screen for said information. The write gun writes a positive charge corresponding to the electrical input information onto the storage grid. The flood gun, which provides a beam which floods the entire storage grid, is operated at a suitable potential during the read operation so that electrons pass through the foraminous storage grid and excite the phosphor screen to provide a light image corresponding to the charge information written on the storage grid. In this manner, a visual display is formed. The display is erased by charging the storage grid sufficiently negative to prevent the passage of the viewing beam electron from the flood gun. This is normally accomplished by applying a positive pulse to the backplate of the storage grid thereby causing the viewing beam electrons to collect on the insulating coating on the storage grid.

Brightness, contrast and resolution are problems that face designers of electronic tubes in this area. In U.S. Pat. No. 3,088,048 by Ogland et al, a storage display tube is described in which an additional control grid is provided between the storage grid and the phosphor screen. This patent describes a technique associated with such a control grid to suppress electron bombardment of the phosphor display screen during the erase cycle and thereby suppress the generation of light flashes from the screen that may arise during the erase cycle. By this technique, one is able to further enhance the capability of the storage display tube as far as viewing a scene in bright ambient light conditions. The structure described in the Ogland et al patent results in a slight loss in the brightness in comparison with a conventional storage tube wherein no suppressor grid is provided between the storage grid and the phosphor screen. The brightness in all display tubes is presently limited by the flood gun cathode current made available to the display screen through the storage assembly.

SUMMARY OF THE INVENTION

This invention is directed to an improved storage display tube in which a current gain electrode is provided between the storage grid and the phosphor screen so as to increase the amount of current directed onto the phosphor screen. This current gain electrode is provided between the storage grid and the phosphor screen comprises an electrically conductive mesh with a secondary electron emission coating on the mesh having a ratio of secondary electron emission greater than one within the normal operating voltage of the tube.

BRIEF DESCRIPTION OF THE DRAWING

For a better understanding of the invention, reference may be had to the preferred embodiment, exemplary of the invention, shown in the accompanying drawing, in which.

DESCRIPTION OF THE PREFERRED EMBODIMENTS

Figure 1:
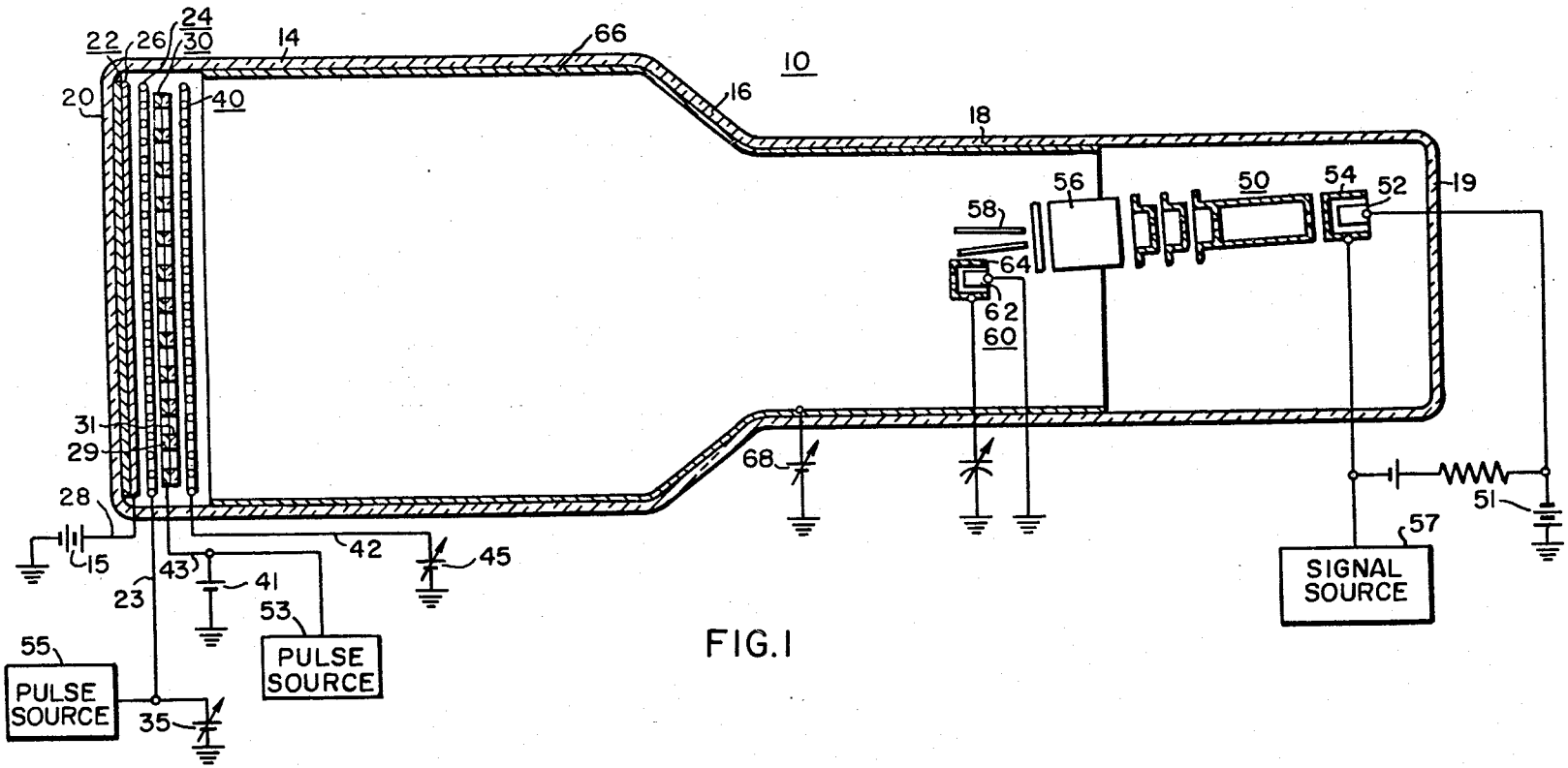
FIG. 1 is a schematic diagram of a direct view storage tube in accordance with the teachings of this invention.
Figure 2:
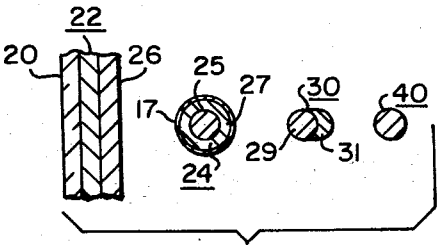
FIG. 2 is an enlarged view of the storage grid assembly of FIG. 1.

Referring to FIG. 1, a direct view storage tube comprising an evacuated envelope 10 is illustrated. The envelope 10 is comprised of an enlarged tubular portion 14 connected by a tapered portion 16 to a tubular neck portion 18 of smaller diameter than the tubular portion 14. The tubular portion 14 is closed at its other end by a face plate portion 20 of suitable light transmissive material such as glass. The other end of the neck portion 18 is closed by a suitable base portion 19 containing lead-in members (not shown) for applying voltages to the electrodes provided within the envelope 10.

An electron sensitive coating 22 is provided on the inner surface of the face plate 20. The electron sensitive coating 22 is the display screen and may be of a suitable phosphor material which emits light in response to electron bombardment. A suitable phosphor material is zinc sulfide. The phosphor coating 22 is also provided with an electrical conductive coating 26 of a suitable material such as aluminum. A lead 28 is provided to the exterior of the envelope 10 from the electrical conductive coating 26 and is connected to a suitable potential source 15. The potential applied to the conductive coating 26 may be about 10,000 volts positive with respect to ground.

Disposed adjacent to the phosphor screen 22 is a current gain electrode 24. The current gain electrode 24 may be positioned at a distance of about 0.100 to 0.200 inch from the screen 22. The current gain electrode 24 may be fabricated of a suitable electrical conductive material such as nickel which is formed into an electro-formed mesh 25 with about 500 lines per inch. The nickel mesh 25 is provided with an exterior coating 27 of a suitable electrically conductive material such as aluminum to provide a thin coating over the entire surface of the mesh 25 of a few micromillimeters. The normal process for providing the coating 27 is to evaporate aluminum from one side of the mesh 25 and then turn the mesh 25 over and evaporate from the other side. The electrode 24 is then exposed to air which forms a thin coating 17 of $Al_2O_3$. The layer 17 has a thickness of less than one micron. In the specific embodiment, the thickness of the layer 17 is about 20 Angstroms. The current gain electrode 24 is connected to a suitable potential source 35 by means of a lead-in 23. The potential source 35 may be at a potential of about 75 volts with respect to ground.

A storage grid 30 is disposed adjacent to the current gain electrode 24 and on the opposite side thereof with respect to the screen 22. The storage electrode 30 is comprised of a mesh 29 of a suitable electrical conductive material such as nickel having about 500 lines per inch. The mesh 29 is provided with a coating 31 thereon of a suitable insulating material such as magnesium fluoride. Other suitable materials are $SiO$, $CaF_2$ and $Al_2O_3$. This coating 31 is disposed on the side of the mesh 29 remote with respect to the screen 22. It may have a thickness of about 2 micrometers. The storage grid 30 is disposed at a distance of about 0.005 to 0.050 inch from the current gain electrode 24. The storage grid 30 is also connected to a suitable potential source 41 by means of a lead-in 43. The potential source 41 may provide a potential of about 15 volts with respect to ground. It is also possible to provide other suitable coatings on the mesh 25. For example, $MgF_2$, SiO and other metal oxides may be used to provide a suitable secondary emissive material coating of suitable properties.

A collector mesh 40 is disposed on the opposite side of the storage grid 30 with respect to the screen 22. The collector mesh 40 is positioned at a distance of about 100 mils from the storage grid 30. Here again, the collector mesh 40 is of an electrical conductive material such as nickel having about 500 lines per inch. The collector mesh 40 is also connected by a lead-in 42 to a suitable potential source 45. The potential source 45 may provide a potential of about 265 volts with respect to ground.

An electron gun 50 is positioned within the neck portion 18 for generating and directing an electron beam onto the storage grid 30. The electron gun 50 is a writing type gun which generates an electron beam of a small spot size. The writing gun 50 may be of any suitable construction to provide such a beam and comprises at least a cathode 52 and a control grid 54. The cathode 52 may be connected to the negative terminal of a suitable potential source 51 of about 2000 volts with the positive terminal connected to ground. The control grid 54 is connected to a signal source 57 with a suitable bias as illustrated. Horizontal and vertical deflection plates 56 and 58 are provided for deflecting the electron beam from the electron gun 50 over the storage grid 30. Suitable deflection voltages are applied to the plates 56 and 58 to scan the elemental electron beam from the electron gun 50 over the storage grid 30.

Also positioned within the neck portion 18 of the envelope 10 is a second electron gun structure 60 which may be referred to as the viewing or reading gun and it performs the function of reading and erasing information on the storage grid 30. The flooding gun 60 provides a large area beam so as to substantially flood the entire area of the storage mesh 30. The flood gun 60 includes at least a cathode 62 and a control grid 64. The cathode 62 may be connected to ground potential. A wall coating 66 extends from just in front of the electron gun 60 to near the collector grid 40. The wall coating 66 is connected to a suitable potential source 68 and is operated at a potential of about 77 volts positive with respect to ground. The wall coating 66 is normally an electrical conductive coating of suitable material such as Aquadag and is normally referred to as a collimating electrode for directing the flooding electron beam onto the storage grid 30 so that the electrons approach substantially normal to the surface thereof.

In the normal operation of the device and prior to the writing operation, the storage grid back plate 29 may be pulsed to a potential of about 20 volts positive with respect to ground by means of a suitable potential source 53. The flooding electron gun 60 will direct electrons onto the dielectric storage surface 31 causing the surface 31 to charge to a potential of about ground. The potential difference across the dielectric at this time is about 20 volts. It is also customary in the operation of this device to pulse the control electrode 24 to a relatively high negative potential of about 82 volts by a suitable source 55 in order to suppress any electrons passing through to the phosphor screen 22. At the end of the positive erase pulse, the electrode 29 will return to a positive potential of about 15 volts. The charge stored on the dielectric surface 30 changes from ground potential to a negative potential approximately equal to about 5 volts negative with respect to ground due to capacitive coupling. This voltage is normally adequate to cut off the tube.

During the writing operation, the electron gun 60 is modulated by the signal from the signal source 57 and generates a small pencil type electron beam which is deflected over the storage grid 30 by means of the deflection plates 56 and 58. The cathode 52 of the writing gun 50 is generally operated at a potential of about 1500 to 2500 volts negative with respect to ground. The signal source 57 modulates the control grid 54 of the writing gun in accordance with the information to be written onto the storage grid 30. The collector grid 40 is operated at a positive potential of about 265 volts. In those areas, where the electrons from the modulated electron beam land on the storage grid 30, the electrons have sufficient velocity to produce a greater number of secondary electrons than incident primary electrons. Thus, more electrons leave the storage grid 30 than arrive on these elements of the storage grid struck by the write beam and the surface 31 of storage grid 30 assumes a less negative charge. The secondary electrons emitted from the storage grid 30 are attracted and collected by the collector grid 40. Thus, the storage elements may be charged to any potential intermediate between the storage grid cut-off voltage, in which the specific embodiment discussed here is a negative 5 volts, and zero potential. In this manner, a storage pattern may be written onto the storage grid 30 by the writing gun 50 in accordance with the modulation applied to the control grid 54 of the writing gun 50 from the signal source 57.

In the viewing operation, the viewing gun 60 provides a low velocity electron beam which continually floods the entire collector grid 40 and the storage grid 30. A display with exceptional brightness is possible because of the high viewing gun current. The high current can be obtained because the viewing beam is not controlled by the methods ordinarily employed in cathode ray tube guns and consequently is not limited by focusing, deflection and other modulation requirements. The coating 66 collimates the flooding electron beam so that the electrons approach the storage grid 30 substantially normal to the surface. The collector grid 40 and associated coating 66 serve to accelerate the electrons in the viewing beam and to repel any positive ions which may be generated within the volume between the electron guns 50 and 60 and the storage grid 30. The potential or charge on the storage element 31 of the storage grid 30 determines the number of viewing beam electrons passing through the aperture in the storage grid 30 in the immediate vicinity of the element 30.

When the potential of the storage grid 30 is such as to allow passage of electrons, these electrons are accelerated by means of the positive potential of about 75 volts applied to the current gain electrode 24 and the 10,000 volts applied to the aluminum coating 26. These electrons passing through the storage grid 30 bombard the current gain electrode 24 causing the generation of additional electrons so as to substantially multiply the amount of current passing through the storage grid toward the screen 22. The time constant of the circuit comprising the impinging electron beam and the coating 17 is substantially greater than the time constant associated with the coating 31.

Figure 4:
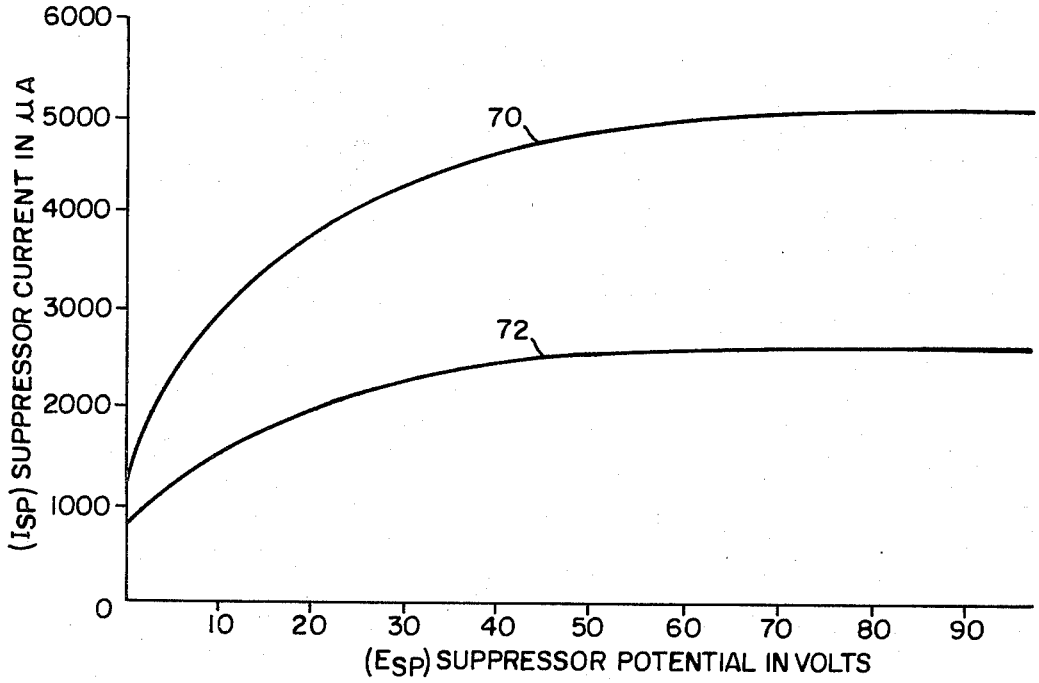
FIG. 4 indicates the brightness improvement of the tube in FIG. 1 over the prior art.

FIG. 4 illustrates the light output plotted with respect to voltage on control grid from two different storage tubes which have a control grid positioned between the screen 22 and the storage electrode 30. The curve 70 is representative of the device as described in this invention. The curve 72 illustrates a prior art type of device as described in the previously mentioned U.S. Pat. No. 3,088,048.

Figure 3:
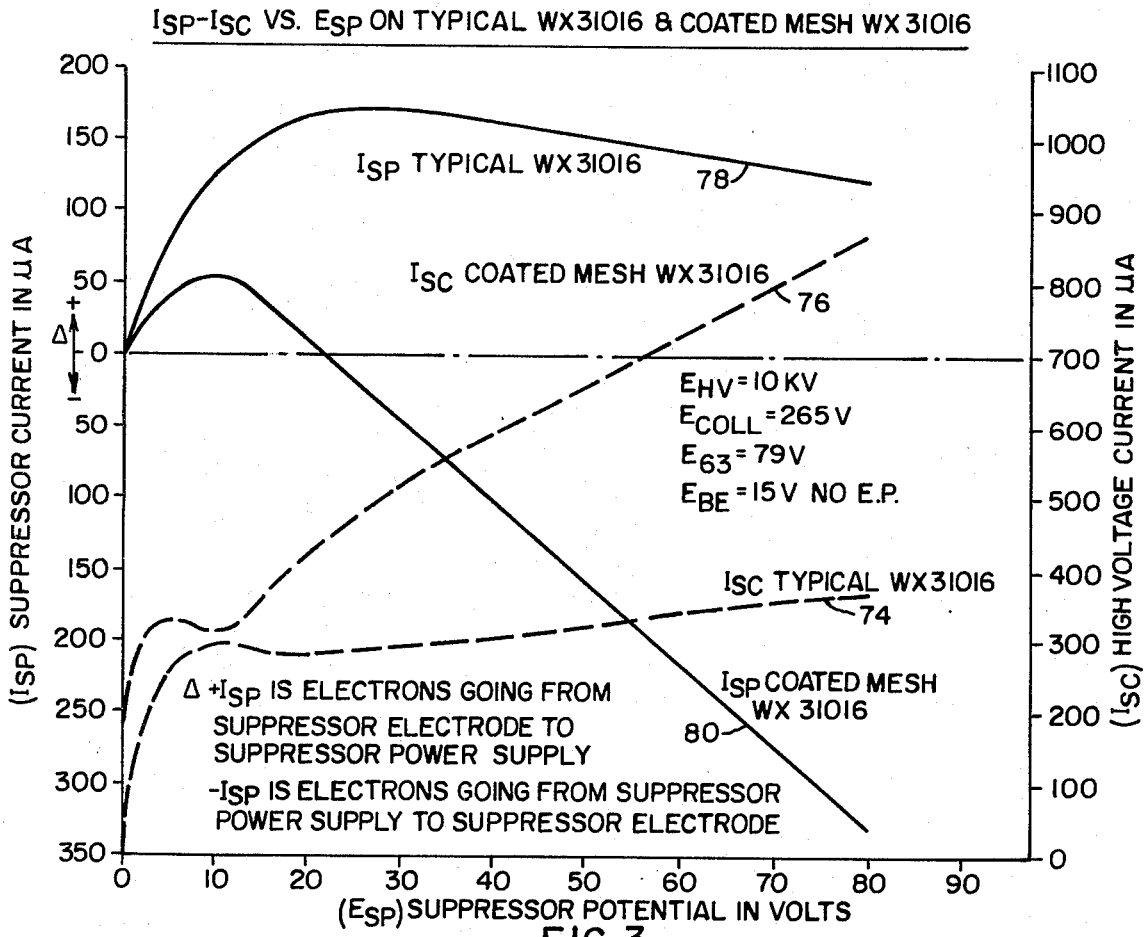
FIG. 3 are curves illustrating the operation of the tube shown in FIG. 1 in comparison with prior art tubes within a set of operating voltages.

In FIG. 3, the current to the screen 22 obtained from the prior art with different voltages applied to a grid between the screen 22 and the storage grid 30 is illustrated by curve 74. A device according to the teachings of this invention is illustrated by curve 76. Also illustrated in FIG. 3 is a comparison of current to the control grid between the screen 22 and the storage grid 30 obtained from a prior art device is illustrated as curve 78 and that from a device in accordance with the teaching of this invention is illustrated as curve 80.

Although the present invention has been described with a certain degree of particularity, it should be understood that the present disclosure has been made only by way of example and numerous changes may be resorted to without departing from the spirit and scope of the present invention.

What is claimed is:

1. A cathode ray tube storage system comprising an evacuated envelope and having therein a phosphor display screen, a non-storage current gain control grid closely spaced from the phosphor screen comprising an electrically conductive mesh with a thin coating of secondary electron emissive dielectric material disposed on the conductive mesh, which current gain control grid increases the electron current passing between the storage grid and the screen, a storage mesh spaced from the current gain control grid on the side opposite from the screen, which storage mesh comprises a conductive mesh and a dielectric coating on the mesh side opposite the screen for storage of charge in response to electron bombardment, a collector grid spaced from the storage mesh on the opposite side of the storage mesh from the screen, a writing electron gun for generating an electron beam to write a charge on the storage mesh, and a flood electron gun for generating and directing electrons through the storage mesh.

2. The cathode ray tube storage system specified in claim 1, wherein the secondary electron emissive dielectric material on the conductive current gain control grid is aluminum oxide which is disposed to a thickness of less than about one micron.

3. The cathode ray tube storage system specified in claim 1, wherein the conductive current gain control grid includes a layer of aluminum upon which the aluminum oxide is disposed.

* * * * *